United States Patent [19]

Delso

[11] Patent Number: 4,502,250

[45] Date of Patent: Mar. 5, 1985

[54] GRINDING APPARATUS

[75] Inventor: James A. Delso, Alsip, Ill.

[73] Assignee: 3-D Enterprises, Inc., Alsip, Ill.

[21] Appl. No.: 416,989

[22] Filed: Sep. 13, 1982

[51] Int. Cl.[3] ..... B24B 5/38

[52] U.S. Cl. ..... 51/80 A; 51/87 R

[58] Field of Search ..... 51/80 A, 81 R, 87 R, 51/80 R; 15/88

[56] References Cited

U.S. PATENT DOCUMENTS

| | | | |
|---|---|---|---|
| 223,657 | 1/1880 | Tasker | 51/87 R |
| 1,647,499 | 11/1927 | Bly | 15/88 |
| 1,857,832 | 5/1932 | Bailey | 51/80 |
| 1,891,331 | 12/1932 | Lord . | |
| 1,950,555 | 3/1934 | Hunter | 51/80 A |
| 2,021,371 | 11/1935 | Manchester | 51/402 |
| 2,260,783 | 10/1941 | Morley | 15/88 |
| 2,355,174 | 8/1944 | Nye | 51/80 A |
| 2,383,927 | 8/1945 | Carlson | 51/90 |
| 2,571,632 | 10/1951 | Vinell et al. | 51/80 |
| 2,612,730 | 10/1952 | Lowe | 51/5 |
| 2,619,663 | 12/1952 | Johnson et al. | 15/88 |
| 2,782,567 | 2/1957 | Opalick | 51/87 |
| 2,887,702 | 5/1959 | Freitag | 15/23 |
| 3,432,971 | 3/1969 | Conti | 51/80 |
| 3,477,177 | 6/1969 | Williams et al. | 15/23 |
| 3,694,843 | 10/1972 | Seifert | 15/88 |
| 3,702,489 | 10/1972 | Nakamura et al. | 15/88 |
| 3,889,427 | 6/1975 | McCoy | 51/80 A |
| 3,895,463 | 7/1975 | Brandli et al. | 51/87 R |
| 3,976,815 | 8/1976 | Brekle | 427/292 |
| 4,033,075 | 7/1977 | Verbickas | 51/80 A |
| 4,156,949 | 6/1979 | Ziegelmeyer | 15/88 |
| 4,218,800 | 8/1980 | Przygocki | 15/88 |

FOREIGN PATENT DOCUMENTS

| | | | |
|---|---|---|---|
| 647980 | 7/1928 | France | 51/80 A |
| 357046 | 11/1961 | Switzerland | 51/87 R |

*Primary Examiner*—Harold D. Whitehead

*Attorney, Agent, or Firm*—Fitch, Even, Tabin & Flannery

[57] ABSTRACT

A grinding machine for continuous descaling, cleaning and polishing of steel wire and the like employs a plurality of grinding wheels which are self-adjusting for wear and self-trimming so that no manual adjustment or trimming is required for the life of a wheel. The wheels are made of an open-pore resilient abrasive material and canted with respect to the workpiece to provide more effective descaling than that provided by prior art grinding machines. Guides are employed to align and straighten the workpiece as it is moved past the grinding wheels.

7 Claims, 7 Drawing Figures

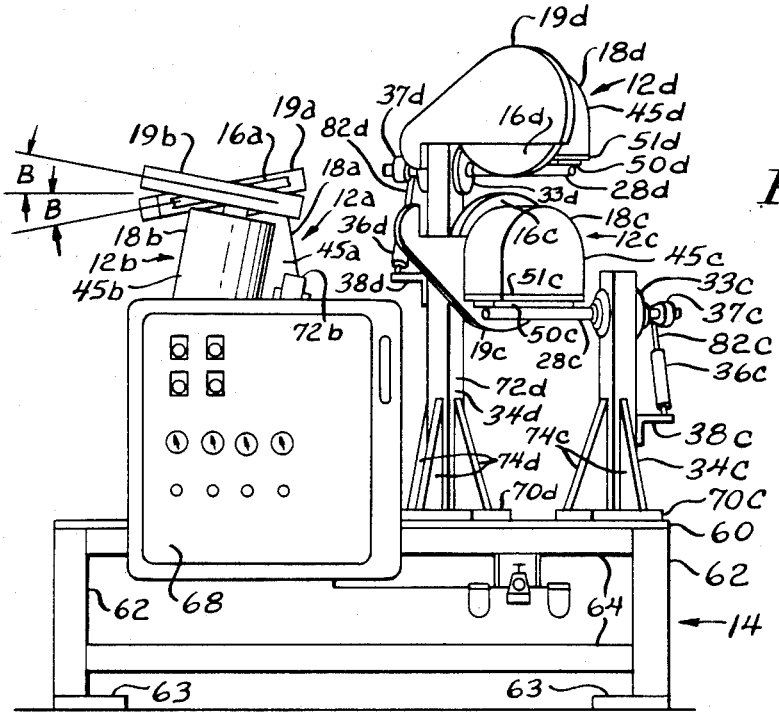
FIG. 4
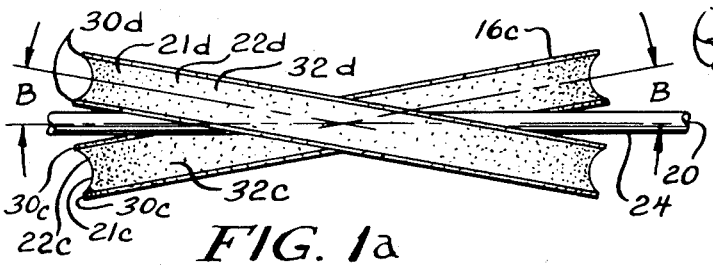
FIG. 1a
FIG. 5
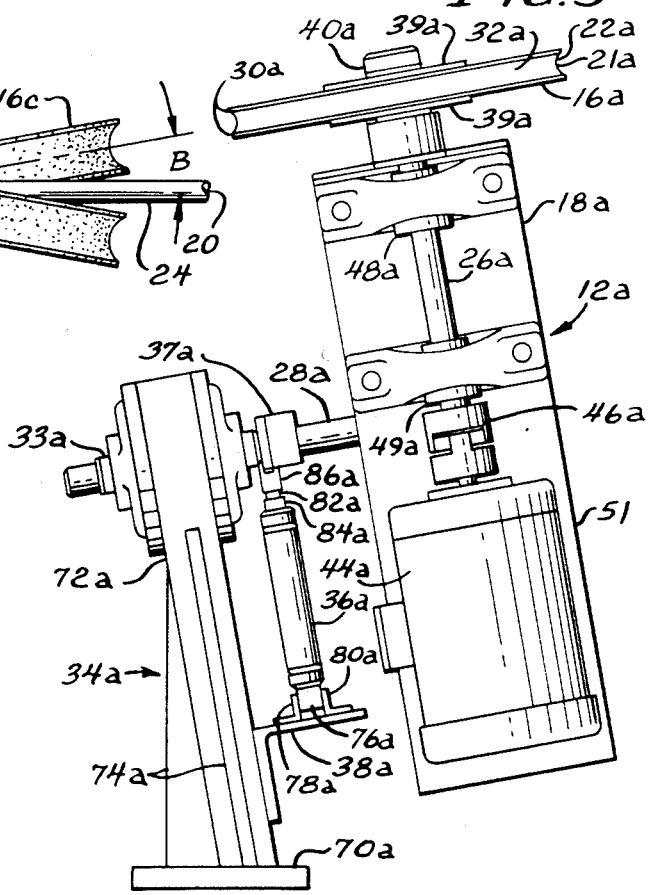

GRINDING APPARATUS

The present invention relates generally to grinding machines and more particularly to an improved grinding machine for descaling, cleaning, and polishing of metal wire and similar products.

The present invention will be described in connection with its preferred usage of removing surface material from ⅜ inch to 1 inch diameter steel wire or rod, which is unwound from a coil and is fed continuously to an automatic screw or header machine which makes parts such as threaded fasteners from the wire or rod. The present invention is not limited to this particular application thereof.

In preparing steel wire or rod to be fed to an automatic screw machine, it is desirable that the entire surface of the wire or rod be descaled at a high rate of speed. Two commercial methods presently used for descaling steel wire and the like are pickling and shot blasting. Pickling involves immersion of the workpiece in an acid bath for a period of time calculated to permit scale to be dissolved without causing substantial loss of material from the underlying stock. It is difficult to obtain complete descaling with this process, and it is also difficult to prevent loss of stock. Disposal of the liquid waste products is costly and presents safety hazards and pollution problems. In addition, the equipment used for the pickling operation is generally bulky and expensive, and the process itself is time-consuming and cannot be done in conjunction with and adjacent to headers or screw machines.

Shot blasting involves directing a multiplicity of small metal projectiles toward the workpiece at high velocity to knock the scale loose. Shot blasting equipment is expensive and generally has a relatively short life, and maintenance costs on the equipment are generally high. This method also tends to leave a peened surface on the underlying steel, which is undesirable.

Attempts to develop a satisfactory grinding machine for industrial use in descaling steel wire as it is removed from a coil and fed into an automatic machine such as a header or screw machine have been unsuccessful largely due to the following difficulties. First, because the wire is generally not straight when it is removed from a coil, the machine should be able to accommodate bends in the workpiece. Such bends may create harmful dynamic loads on machine parts such as grinding wheels as the workpiece advances, and may hamper scale removal by changing the alignment of the workpiece with respect to grinding wheels causing the wheels to grind too much on one side and not enough on another side. Secondly, it is desirable that the workpiece be advanced through the grinding machine at a high rate of speed. With high speeds and long wires the grinding machine the grinding wheels will be removing large quantities of scale. The grinding machine should therefore be capable of removing scale at a high rate of speed. With high speeds and long wires the grinding machine will be removing large quantities of scale. Thirdly, conventional grinding wheels tend to become clogged with scale particles so that their abrasive surfaces lose their effectiveness. Fourthly, the machines should be relatively free of maintenance and the need for stopping the machine throughput for wheel adjustments or wheel dressings. Fifthly, it is difficult to grind about the 360° circumference of a small diameter elongated continously traveling rod or wire.

The prior art is replete with various types of grinding apparatus, but none has satisfactorily met the above difficulties. Planetary grinding machines such as that disclosed in U.S. Pat. No. 4,218,800 have been employed to descale steel wire, but have not solved these difficulties. Such planetary grinders are typically bulky, mechanically complex, and expensive to manufacture and to maintain. Some of these prior art machines employ hard surface grinding wheels which tend to become clogged with scale particles and thereby lose their effectiveness. Others employ wire brush wheels or wheels having abrasive cloth flaps extending radially from a spinning core.

In addition to the planetary machines, other proposals include machines which bend a wire over a number of sheaves to remove loose scale, then subject the wire to abrasive contact with brushing wheels. One such proposal is disclosed in U.S. Pat. No. 3,702,489. Such machines contemplate use of small diameter and flexible wire. Bending also places stresses and strains on the wire that may lead to cracks in the wire or articles made therefrom. One such proposal is disclosed in U.S. Pat. No. 3,702,489.

Thus, there is a long felt need and want for an improved grinding apparatus for elongated wire or rod.

Accordingly, it is an object of the present invention to provide a new and improved grinding machine for removing scale and the like from steel wire and similar products.

Other objects and advantages of the present invention will become apparent from the following detailed description and the accompanying drawings in which:

FIG. 1 is a front elevational view of a grinding machine embodying the present invention.

FIG. 1*a* is an enlarged schematic view taken substantially along lines 1*a*—1*a* in FIG. 1.

FIG. 4 is a front elevational view of an alternative embodiment of the present invention.

FIG. 5 is an enlarged front elevational view of one of the grinding assemblies of the grinding machine of FIG. 1 with part of the housing removed to reveal the motor and drive shaft.

Figure 1:
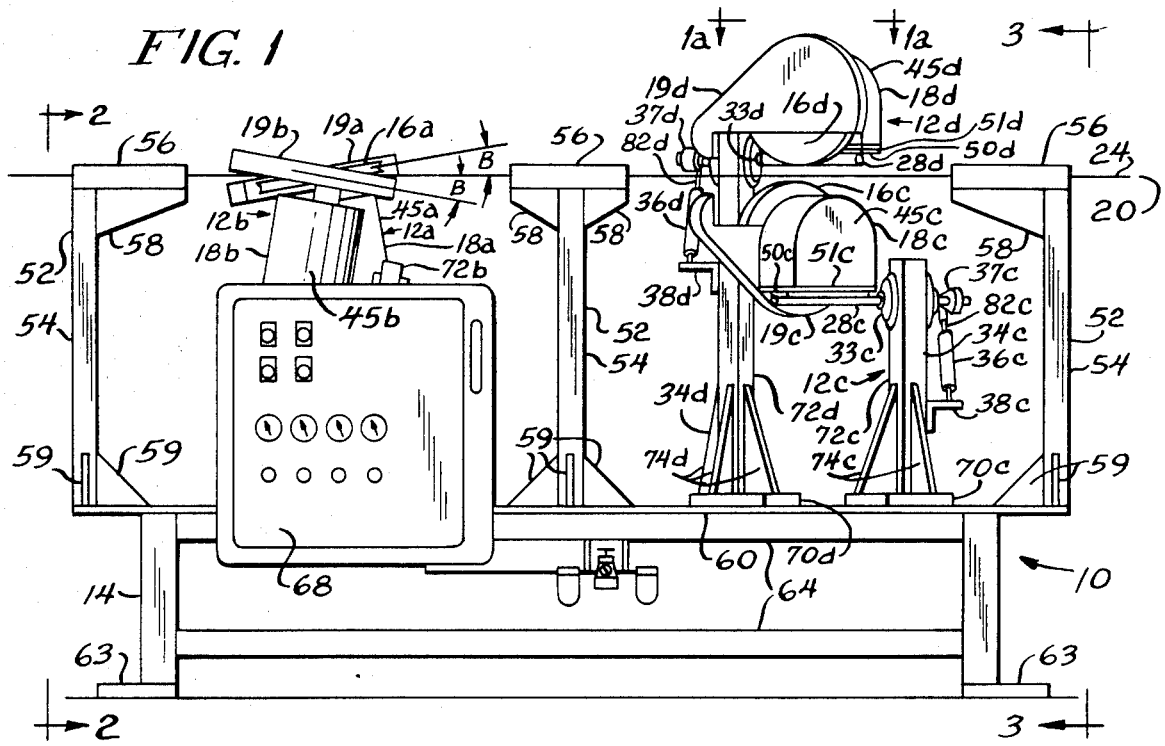

As shown in the drawings for purposes of illustration, the present invention is generally embodied in a grinding machine 10 (FIG. 1) having a plurality of grinding assemblies 12 mounted on a frame 14. Each of the components which are common to all of the grinding wheel assemblies is identified by a single numeral in the following description, and the letters a, b, c, and d will be used to distinguish the four grinding wheel assemblies employed in the preferred embodiment from one another.

Each grinding assembly 12 includes a grinding wheel 16 mounted on a pivoting arm or head 18. A guard 19 partially encompasses each wheel to contain the material loosened by the wheel. Vacuum hoses (not shown) may be positioned near each guard to remove this material from the work area. The grinding wheels are positioned to engage an elongated workpiece 20 which is continuously moved past the grinding wheels 16 by external means (not shown). The present invention may be used for cleaning and polishing elongated metal workpieces of various shapes and dimensions, and is particularly well-suited for removing scale from steel wire such as ⅜ inch to one inch in diameter used in automated equipment to make rivets, screws, threaded fasteners, or the like an automatic screw machines.

Heretofore, grinding machines employed for removal of scale from steel wire have proven unsatisfactory. Such machines have not been effective in completely removing the scale from the workpiece and have generally been bulky and expensive. Also, they require too much maintenance or down time for use immediately before or conjunction with an automatic screw machine. Such screw machines are run continuously or as close thereto as possible and are fed from long coils of wire which means a large quantity of scale should be removed without stopping for maintenance or adjustment of the grinding machine. Other commonly used commercial methods of scale removal, such as shot blasting and pickling, discussed above, are also costly, and pickling has significant disadvantages relating to disposal of liquid waste. Thus, there is a long felt want and a need for an improved method of removing scale and the like from steel wire and similar products.

In accordance with the present invention a new and improved grinding machine 10 is provided which can remove scale or other surface imperfections from elongated workpieces, for example rod or wire such as that to be cut and fed to automatic screw machines. To this end, the machine employs a plurality of grinding wheels 16 which are self-adjusting for wear and self-trimming so that minimal or no manual adjustment or trimming is required for the life of a wheel, and which are oriented so that their peripheral surfaces 22 engage intersecting circumferential portions of the work surface 24 as they spin to cooperate in providing a good cleaning of the work surface while permitting fast throughput of the workpiece 20. To grind effectively about the 360° circumference of a small diameter wire, each grinding wheel has a concave groove 21 extending around its peripheral surface 22 which partially wraps about the 360° circumference of a small diameter wire, each grinding wheel has a concave groove 21 extending around its peripheral surface 22 which partially wraps around the workpiece 20 as the wheel engages it rather than merely having a line contact with the workpiece; and also to assist in achieving good abrasion of a relatively large circumferential portion of the work surface 24 by each of the grinding wheels 16, each wheel is canted at a small angle B (FIGS. 1, 1*a*), preferably between 5° and 15°, with respect to the direction of travel of the workpiece. It has been found that with this configuration, the motion of the grinding wheels 16 relative to the work surface and the pressure distribution over the contact area provide effective removal of scale or other undesirable material from the surface of the workpiece 20. The preferred grinding wheels 16 are resilient and relatively open pore abrasive material. One such material is used in "Scotch-Brite" Brand Clean 'n Strip wheels manufactured by Minnesota Mining and Manufacturing Company. Employment of this resilient and open pored material permits the wheels 16 to conform to irregularities in the work surface 24 so that uniform abrasion of the surface can be obtained regardless of such irregularities, and the wheels 16 do not tend to clog or become filled with abraded material because they are open pore.

It will be appreciated that as the grinding wheels 16 wear they become smaller in diameter. To make the machine self-adjusting for wheel wear, each grinding wheel 16 is mounted on a shaft 26 (FIG. 5) in a pivoted grinding head 18 which is fixed to a rotatable support-means including a rod 28 to which a force is applied to pivot the head toward the work surface 24 on the workpiece 20 to keep the wheel 16 in contact therewith as the diameter of the wheel decreases due to wear. Preferably, the grinding wheel shaft 26 is offset in an eccentric manner with respect to the support rod 28 so that as the head 18 pivots around the support rod 78, the center of rotation of the wheel 16 describes an arc configured to keep the workpiece 20 centered on the peripheral surface 22 of the grinding wheel 16 as that surface 22 wears. The head 18 pivots not only due to wear, but also to accommodate bends in the workpiece 20.

It is desirable to prevent the formation of large flanges on the edges 30 of the grinding wheel 16 as the workpiece 20 wears away the central portion 32 of the peripheral surface 22 of the wheel. Such flanges can be thrown off by centrifugal force and injure workers or equipment. The wheels 16 are made self-trimming by positioning them in pairs opposite one another so that the flanges (not shown) which otherwise would be formed on a wheel are continuously worn away by friction with the flanges on the opposing wheel.

The preferred apparatus includes guides 52 positioned at the ends and midsection of the machine to straighten and align the workpiece 20 as it moves past the grinding wheels 16. These guides are particularly useful when the workpiece is a metal wire which is being fed through the grinding apparatus from a large coil, because such material should be held against shifting movement and be aligned in a general straight line path of travel as the workpiece 20 passes between the grinding wheels after it is removed from the coil.

Referring now in greater detail to the preferred embodiment of the present invention, best viewed in FIG. 1, four grinding assemblies 12*a*, 12*b*, 12*c* and 12*d* are disposed on the machine frame 14 so that two horizontally opposed grinding wheels 16*a* and 16*b* engage a portion of the workpiece 20 from opposite sides while two vertically opposed grinding wheels 16*c* and 16*d* engage another portion of the workpiece from the bottom and top respectively. As the workpiece 20 axially moves from one end of the machine to the other, substantially its entire surface 24 is abraded by the wheels 16.

As best seen in FIGS. 1 and 1*a*, each grinding wheel is canted at an angle B with respect to the axis of the workpiece. It has been found that the machine is effective if angle B is within a range of 5° to 15°. In the preferred embodiment of the present invention, the value of angle B is 10°.

Each grinding assembly is pivotally mounted on a supporting frame or stand 34 and each grinding assembly includes a head 18 fixed to a rotatable support rod 28 which is journaled through a bearing 33 mounted in its stand 34. Herein, each stand consists of a horizontal base plate 70 at its bottom with a column 72 extending upwardly therefrom which is reinforced at its lower end with braces 74. Two stands 34*a* and 34*b* have their columns canted with respect to the vertical at angle B so that their associated grinding wheels are canted with respect to the axis of the workpiece as described above, and two stands 34*c* and 34*d* have vertical columns which are twisted to give their associated grinding wheels the necessary cant.

The preferred means for applying force to pivot the head 18 forward into contact with the workpiece includes a fluid motor such as an air cylinder 36. As best viewed in FIG. 5, the lower end 76 of the air cylinder 36 is pivotably mounted between two short lengths 78 and 80 of angle iron fixed to a platform 38 projecting from the stand 34. A pin (not shown) holds this end 76 in place. Variation of air pressure supplied to the cylinder imparts axial motion to a piston rod extending from the upper end 84 of the cylinder, and the upper end of the piston rod is connected to a clevis 86 which is pinned to a lever arm 37 which is rigidly attached to the support rod 28 to rotate it when air pressure is increased. Thus, air pressure keeps the grinding wheel 16 in contact with the workpiece 20 as the wheel wears while maintaining constant pressure between the wheel and the work surface 24, and additionally functions to allow the head to "float"—i.e., to pivot to accommodate bends in the workpiece without gouging the work surface or putting high stresses on the wheel. The heads 18 are disposed in opposing pairs to apply pressure to the workpiece 20 from opposite sides, and a bend in the workpiece which forces one head to pivot back permits the opposite head to pivot forward so that both of the associated grinding wheels 16 remain in contact with the work surface 24.

The preferred air cylinder 36 employs a 1 inch diameter piston (not shown), and during operation air pressure of approximately 100 p.s.i. is maintained. Each head 18 is balanced so that it pivots away from the work surface 24 when cylinder pressure is released.

Figure 6:
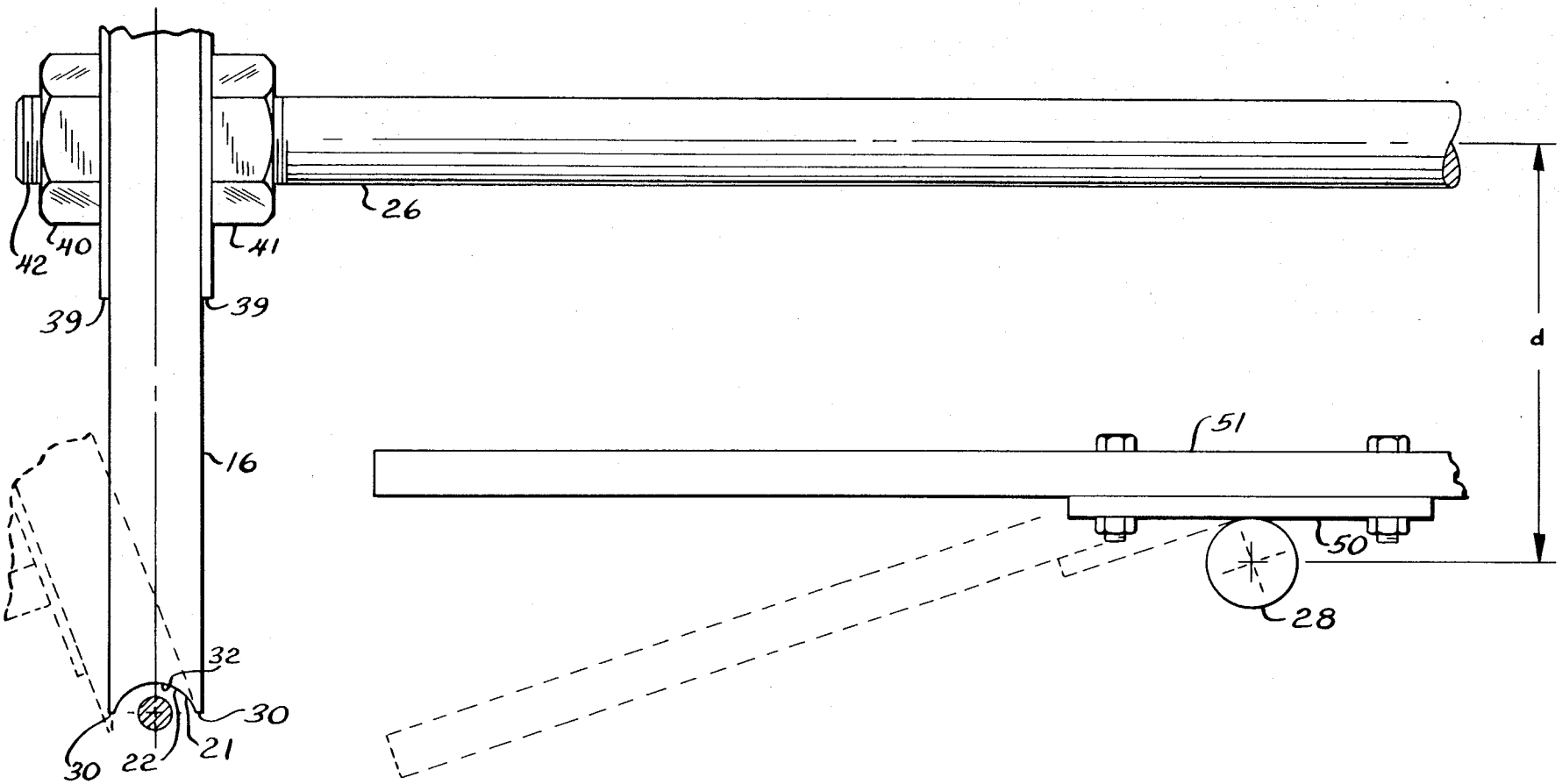
FIG. 6 is a schematic view showing the motion of a pivot arm as its associated grinding wheel wears and decreases in diameter.

Referring now to FIG. 6 and indicating directions with reference thereto, a schematic representation illustrates the motion of the grinding wheel 16 as the head 18 pivots in a counterclockwise direction to compensate for wear on the grinding wheel. The shaft 26 is offset by a distance d from the support rod 28 about which the head pivots. As the wheel wears, the head pivots so that the center of rotation of the grinding wheel moves in an arcuate motion downward and to the left and the axis of rotation of the grinding wheel, which is coincident with the shaft 26, rotates counterclockwise, resulting in the configuration shown in broken lines. If the shaft 26 were not offset from the support rod 28, the pivoting of the head 18 would cause the center of the grinding wheel 16 to move down and toward the right and after a relatively small amount of wear the peripheral surface 22 of the wheel would no longer engage the workpiece 20. In accordance with the present invention, the distance d of the offset is calculated to cause the wheel to describe an arc such that the workpiece 20 is centered or nearly centered upon the peripheral surface 22 at all times as the wheel wears and its diameter decreases. This permits a wheel to be used for its entire life without adjustment to compensate for the decrease in diameter due to wear.

Referring now to FIGS. 5 and 6, the grinding wheel 16 is tightly clamped between two circular plates 39 and secured by nuts 40 and 41 on a threaded end portion 42 of the drive shaft 26. A motor 44 transmits torque to the drive shaft 26 through a coupling 46. The drive shaft 26 is journaled through two bearings 48 and 49 mounted in the head 18. A housing 45 encloses the motor and the drive shaft bearings to exclude foreign matter, and a mounting plate 51 provides structural support for the motor 44 and bearings 48 and 49. The mounting plate 51 is bolted to a backing plate 50 which is welded to the support rod 28.

As illustrated in FIG. 6, the width of each wheel 16 is greater than the diameter of the workpiece 20. This allows the wheel to be canted with respect to the workpiece while maintaining a good wrap—i.e., the groove 21 in the peripheral surface of the wheel wraps around a circumferential portion of the workpiece.

As the groove 21 wears deeper into the central portion 32 of the peripheral surface 22 of the wheel 16, flanges are formed at the edges 30 of the peripheral surface and project radially beyond the worn central portion. It is desirable to keep these flanges trimmed to prevent them from breaking away from the wheel during use. To this end, the wheels 16 are made self-trimming by disposing them in cooperating pairs, best viewed in FIGS. 1, 2 and 3, so that each wheel has its edges 30 continuously trimmed by friction with the edges of another wheel. Wheels 16*a* and 16*b* make up one self-trimming pair, and wheels 16*c* and 16*d* make up a second self-trimming pair.

The material which composes the wheels 16 is a resilient open-pore material. The resilient quality of the material is desirable because it permits the wheel to conform to irregularities in the work surface 24 which might cause a brittle grinding wheel to bounce or skip over portions of the work surface. The open-pore structure of the material prevents particles from filling or clogging the concavities in the grinding surface and reducing its roughness. This clogging effect has been a problem with certain other types of grinding wheels.

The preferred grinding wheels 16 are of the type sold by Minnesota Mining and Manufacturing Company under the name "Scotch-Brite" Brand Clean'n Strip unitized wheels. These wheels are manufactured with flat peripheral surfaces 22 which must be dressed before use by forming a groove 21 around the peripheral surface. The preferred method of dressing a wheel to be used with a round workpiece is to press the end of a cut length of steel conduit against the peripheral surface of the wheel as it spins. The diameter of the conduit should be somewhat greater than the diameter of the workpiece so that the width of the groove formed will be sufficient to accommodate the workpiece at a 5° to 15° cant.

Figure 2:
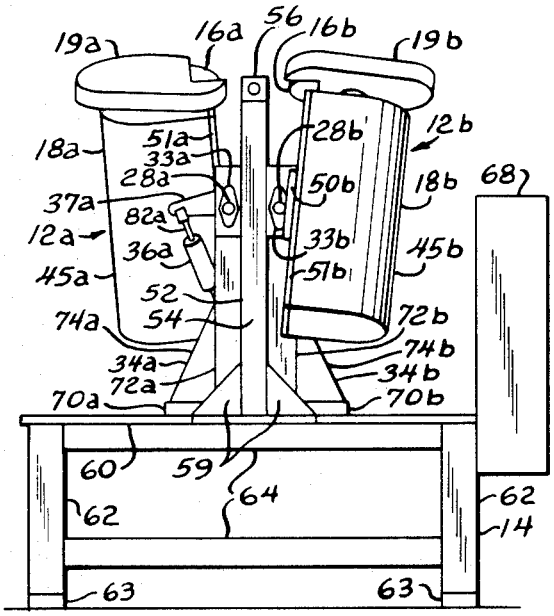
FIG. 2 is a partial end elevational view of the grinding machine of FIG. 1 taken substantially in the direction of lines 2—2 in FIG. 1.
Figure 3:
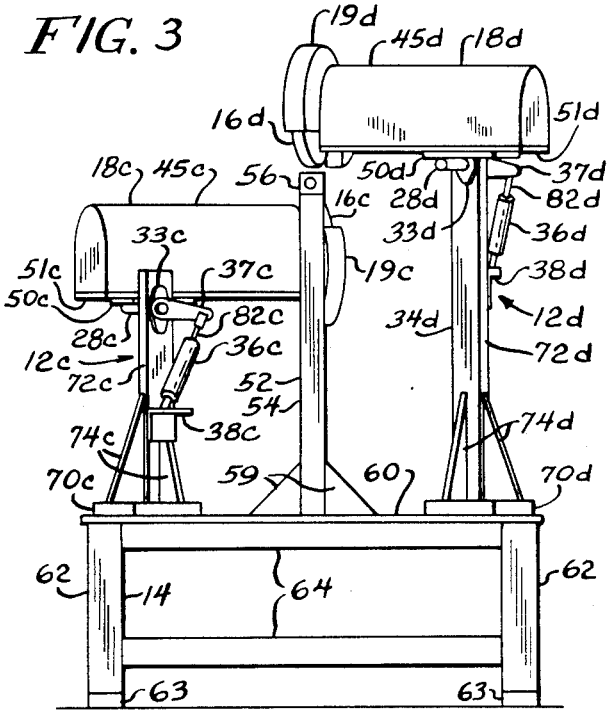
FIG. 3 is a partial end elevational view of the grinding machine of FIG. 1 taken substantially in the direction of lines 3—3 in FIG. 1.

Referring now to FIGS. 1, 2 and 3, each of the preferred guides 52 includes a vertical member 54, supporting a horizontal sleeve 56, with upper reinforcing plates 58 extending between the sleeve and the vertical member and lower reinforcing plates 59 extending between the base and the vertical member to add strength and rigidity. The sleeves are preferably formed of a low friction plastic material such as nylon, teflon or the like. Since the guides 52 are substantially similar, common reference characters are used for identical elements in each. The workpiece passes through the sleeves 56 as it proceeds from one end of the machine to the other. It is desirable to maintain fairly narrow clearances between the workpiece 20 and the inside surfaces of the sleeves 56 so that the workpiece will be held and steadied as it is being ground. Also, large residual bends in the wire workpiece are straightened to allow a straight line path through the machine. The preferred sleeves are adjustable to accommodate workpieces of various sizes and are approximately 8 inches in length.

The machine frame 14 supports the grinding assemblies 12 and guides 52 upon a horizontal base plate 60 which rests on four vertical legs 62 with feet 63 fixed to their bottom ends. Horizontal beams 64 reinforce the structure. A control panel 68 is fixed to the front of the base 14 and positioned for convenient operator access.

FIG. 4 illustrates an alternate embodiment of the invention which differs from the preferred embodiment in that it includes no guides and is more compact.

From the foregoing it may be seen that a new and improved grinding machine is provided which furnishes an economical method of removing scale and the like from steel wire and other elongated metal products. The machine is particularly well-suited for continuous descaling of coiled steel wire, and its grinding wheels are self-adjusting and self-trimming to permit the machine to operate continuously for long periods of time. The preferred embodiment of the invention has been described for illustration only, and this disclosure is not intended to limit the scope of the invention.

Various features of the invention are set forth in the following claims.

What is claimed is:

1. A grinding machine for continuous removal of scale or the like from an exterior surface of an elongated metal workpiece such as a wire or rod which is continuously transported through the machine, the machine comprising:

a frame for the machine, grinding wheels having concave grooves extending around their peripheral surfaces, at least two opposed pairs of grinding wheels being positioned to engage the wire, the grinding wheels in each pair being disposed on opposite sides of the workpiece and engaging each other to be self-dressing with wear of the grinding wheels, said grinding wheels being made of resilient abrasive material having open pores and having grooved peripheral surfaces wrapped around intersecting circumferential portions of the traveling work surface as they rotate, the grinding wheels being uniformly canted at an angle of between 5° and 15° with respect to the direction of travel of the workpiece, means for mounting the grinding wheels on the frame, and motor means for rotating the grianding wheels about their axes.

2. A grinding machine for continuous removal of scale or the like from an elongated metal piece such as a wire or rod which is continuously transported through the machine, the machine comprising:

a frame for the machine, at least two pairs of grinding wheels of grinding wheels disposed to abrade various circumferential portions of the workpiece, means for rotating the grinding wheels about an axis through each wheel, two pair of grinding wheels each having grinding wheels disposed directly opposite each other, each of said grinding wheels mounted on a separate pivoting head, and means for applying force to the heads to pivot them toward the work surface and to urge the grinding wheels into contact with the work surface with a predetermined force, each of said grinding wheels having a concave groove extending arolund its peripheral surface and being positioned so that the groove wraps around a portion of the workpiece to abrade that portion of the workpiece as the wheel spins, the pivoting heads automatically repositioning the grinding wheels on opposite sides of the workpiece with flanges formed on each grinding wheel being continuously trimmed by flanges on the opposing wheel to compensate for wear of their peripheral surfaces, said grinding wheels being oriented so that the workpiece engages a central portion of each of their peripheral surfaces, each grinding wheel and pivotally mounted head being mounted upon a rotating shaft which is offset from a pivot axis so that as the grinding wheel wears the head pivots toward the workpiece, the center of rotation of the grinding wheel describing an arc configured to keep the grinding wheel positioned so that the workpiece remains centered on the peripheral surface of the grinding wheel.

3. A grinding machine in accordance with claim 2 wherein the means for applying the force to the heads comprises air cylinders applying constant torque to the pivoting heads.

4. A grinding machine for continuous removal of scale or the like from an elongated metal piece such as a wire or rod which is continuously transported through the machine, the machine comprising:

a frame for the machine, a plurality of grinding wheels made of a resilient, open-pore abrasive material, each having a concave groove extending around its peripheral surface, the grinding wheels being positioned so that their grooved peripheral surfaces wrap around intersecting circumferential portions of the traveling work surface as they rotate, and each being canted at an angle of between 5° and 15° with respect to the direction of travel of the workpiece, means for rotating the grinding wheels, a plurality of pivoting heads upon which the grinding wheels are mounted, each grinding wheel being mounted on a separate head, a plurality of stands to support the heads on the machine frame, means for applying force to the heads to pivot them toward the work surface to urge the grinding wheels into contact with the work surface with a predetermined pressure, the pivoting heads being configured to keep the grinding wheels positioned so that the workpiece engages a central portion of each of their peripheral surfaces at all times as the heads pivot to compensate for wear on the grinding wheels, the grinding wheels being disposed in opposing pairs on opposite sides of the workpiece so that flanges formed on each grinding wheel due to wear on the center of the peripheral surface of the wheel are continuously trimmed by friction with flanges on the opposing wheel, and guides for straightening and aligning the workpiece as it moves past the grinding wheels.

5. A grinding machine in accordance with claim 4 wherein a total of four grinding wheels are employed.

6. A grinding machine in accordance with claim 5 wherein the means for applying force to the heads comprises air cylinders applying constant torque to the pivoting heads.

7. A grinding machine in accordance with claim 6 wherein a total of three guides are employed, one mounted at each end of the machine and one mounted at the midsection of the machine.

* * * * *